US007069827B1

(12) United States Patent
Hsieh

(10) Patent No.: US 7,069,827 B1
(45) Date of Patent: Jul. 4, 2006

(54) TORQUE INDICATION DEVICE FOR HAND TOOLS

(76) Inventor: Chih-Ching Hsieh, 5F. -2, No. 181, Sec. 2, Mei Tsun Rd., South District, Taichung City (TW)

( * ) Notice: Subject to any disclaimer, the term of this patent is extended or adjusted under 35 U.S.C. 154(b) by 0 days.

(21) Appl. No.: 11/332,338

(22) Filed: Jan. 17, 2006

(51) Int. Cl.
*B25B 23/157* (2006.01)

(52) U.S. Cl. ..... 81/476; 81/478; 81/483

(58) Field of Classification Search ..... 81/476, 81/474–478, 483
See application file for complete search history.

(56) References Cited

U.S. PATENT DOCUMENTS 6,345,436 B1 * 2/2002 Codrington ..... 29/720
6,463,834 B1 * 10/2002 Kemp et al. ..... 81/483
6,722,235 B1 * 4/2004 Hsieh ..... 81/478
6,799,480 B1 * 10/2004 Walsh et al. ..... 73/862.21
7,000,508 B1 * 2/2006 Li et al. ..... 81/479
7,013,769 B1 * 3/2006 Chen ..... 81/473

* cited by examiner

*Primary Examiner*—Lee D. Wilson
*Assistant Examiner*—Alvin J. Grant
(74) *Attorney, Agent, or Firm*—Rosenberg, Klein & Lee

(57) ABSTRACT

A torque indication device for a hand tool includes a handle with a processing unit connected thereto and a head having a driving member connected thereto is rotatably connected to the handle. The head has an insertion which is inserted into an axial recess of the handle. A first notch is defined in a distal end of the insertion. An intermediate member has a second notch defined in a first end thereof and a second end of the intermediate member is a flat surface. A bead is engaged with the first and second notches. A spring is received in the axial recess and a first sensor is clamped between a first end of the spring and the flat surface. A second sensor is clamped between a second end of the spring and an inside of the axial recess. The first and second sensors are electrically connected with the processing unit.

5 Claims, 4 Drawing Sheets

TORQUE INDICATION DEVICE FOR HAND TOOLS

FIELD OF THE INVENTION

The present invention relates to a torque indication device for hand tools and the device includes two sensors connected between a spring so as to provide the central processing unit a precise value.

BACKGROUND OF THE INVENTION

A conventional hand tool such as a wrench for outputting a torque to tighten or loosen an object such as a bolt or a nut generally includes a head and a handle wherein the head includes an engaging member with which the bolt or the nut is engaged. The user rotates the handle to output a torque to rotate the object. However, the user cannot know what value of the torque that is applied to the object so the user can only determine the torque by the feel of the force in the handle. When the torque is overly applied to the object, the teeth of the object are broken and the object is difficult to be unscrewed again. This also does not work when applies a torque to an object on a precise machine because the torque has to be strictly controlled or the structure might be damaged. A conventional torque indication device known to applicant includes a flexible member and a sensor which is connected to a first end of the flexible member and the other end of the flexible member is connected with a processing unit which calculates the amount of deformation of the flexible member to transfer the result by digits. There is a loss of about 4% of the force while being transferred through the flexible member so that the value of the torque is a rough value which does not meet requirements when used to a precise machine.

The present invention intends to provide a torque indication device wherein there are two sensors located on two end of a spring so that the two respective sensors provide respective data to the processing unit to obtain a more precise value.

SUMMARY OF THE INVENTION

The present invention relates to a hand tool that comprises a handle with an axial recess defined in an end thereof and a processing unit is connected to the handle. A head has a driving member connected thereto so as to be engaged with an object and an insertion is connected to the head. A first notch is defined in a distal end of the insertion. An intermediate member has a second notch defined in a first end thereof and a second end of the intermediate member is a flat surface. A bead is engaged with the first and second notches. A spring is received in the axial recess of the handle and a first sensor is clamped between a first end of the spring and the flat surface. A second sensor is clamped between a second end of the spring and an inside of the axial recess. The first and second sensors are electrically connected with the processing unit.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
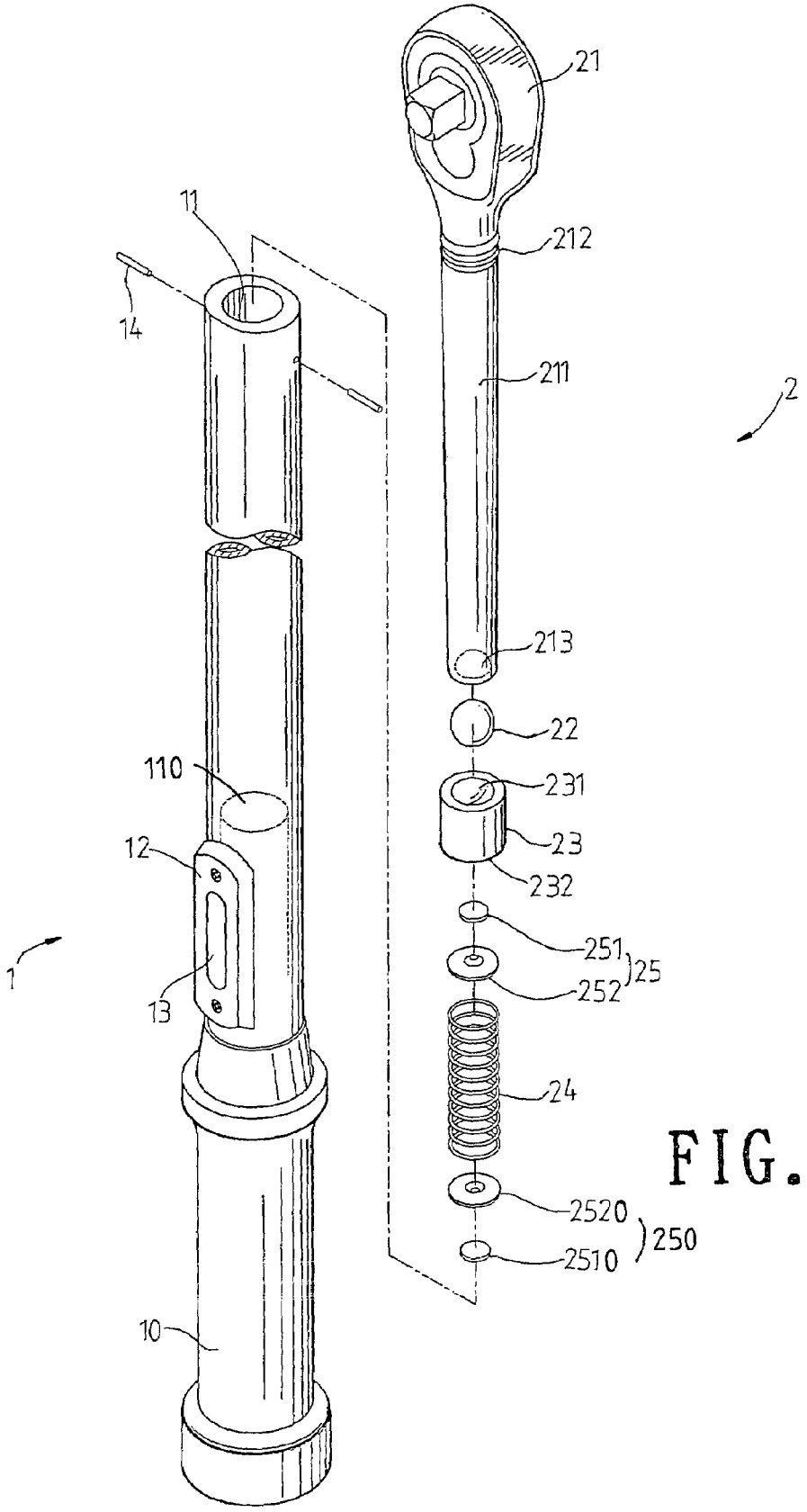
FIG. 1 is an exploded view to show the hand tool and the torque indication device of the present invention.
Figure 2:
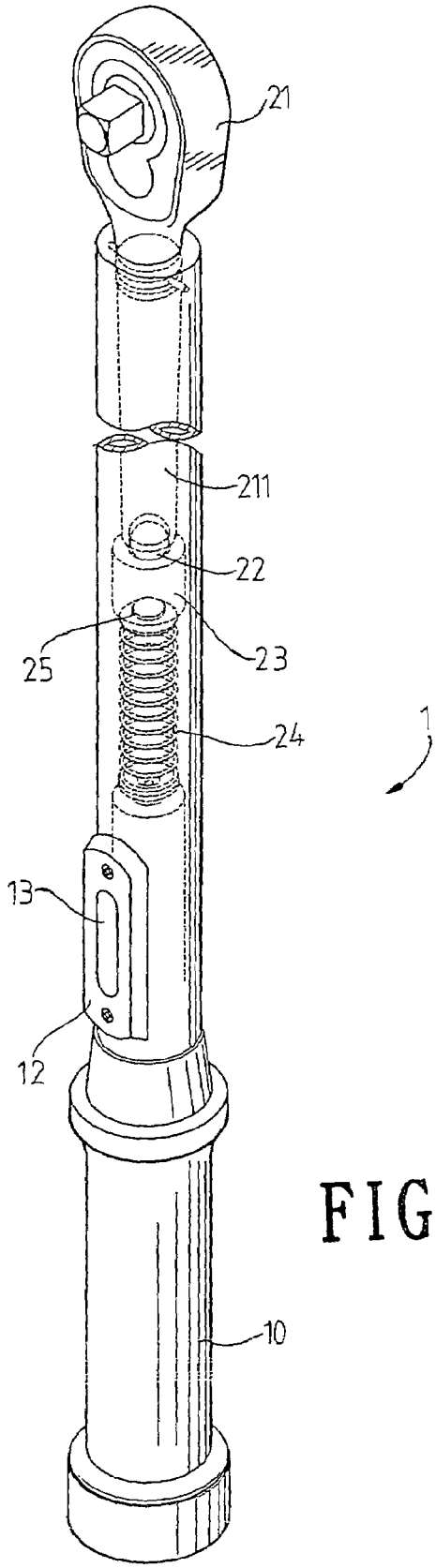
FIG. 2 is a perspective view to show the hand tool with the torque indication device of the present invention received therein.
Figure 3:
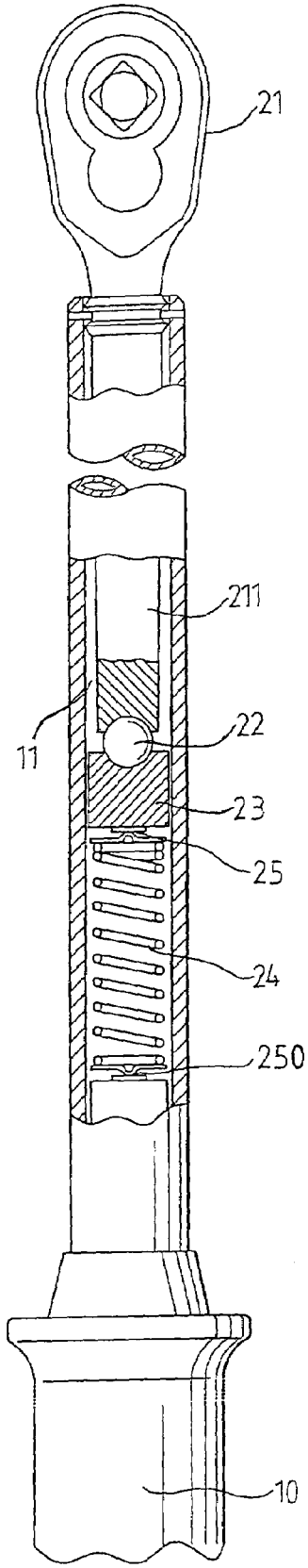
FIG. 3 is a cross sectional view to show the hand tool with the torque indication device of the present invention received therein.

Referring to FIGS. 1 to 3, the hand tool comprises a handle 1 with a grip 10 at one end and an axial recess 11 is defined in the other end thereof. A processing unit 12 is connected to the handle 1 and includes a display screen 13.

A head 21 has a driving member connected thereto so as to be engaged with an object such as a nut, and an insertion 211 is connected to the head 21. The insertion 211 is inserted into the axial recess 11 and includes a groove 212 defined in an outer periphery thereof. Two pins 14 radially extend through a wall of the handle 1 and are engaged with the groove 212 so that the insertion 211 is allowed to be rotatable about an axis of the handle 1. A first notch 213 is defined in a distal end of the insertion 211.

An intermediate member 23 is received in the axial recess 11 and has a second notch 231 defined in a first end thereof. A bead 22 is engaged with the first and second notches 213, 231. A second end of the intermediate member 23 is a flat surface 232. A spring 24 is received in the axial recess 11 of the handle 1 and two sensor assemblies 25, 250 are located at two ends of the spring 24. A first sensor 251 of one of the sensor assemblies 25, 250 is clamped between a first end of the spring 24 and the flat surface 232, a first position disk plate 252 is located between the first sensor 251 and the first end of the spring 24. A second sensor 2510 of the other sensor assembly 250 is clamped between a second end of the spring 24 and an inside 110 of the axial recess 11, a second position disk plate 2520 is located between the second sensor 2510 and the second end of the spring 24. The first and second sensors 251, 2510 electrically connected with the processing unit 12.

Figure 4:
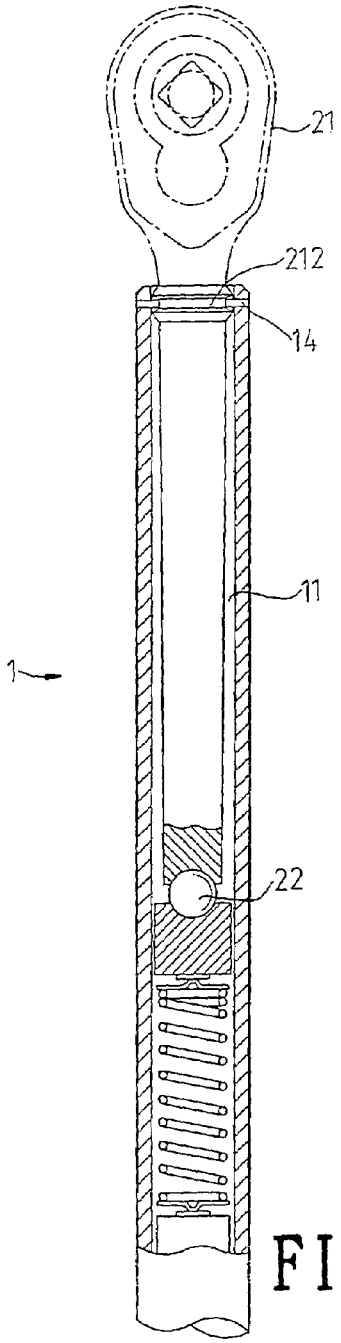
FIG. 4 is a cross sectional view to show the torque indication device in the hand tool of the present invention.
Figure 5:
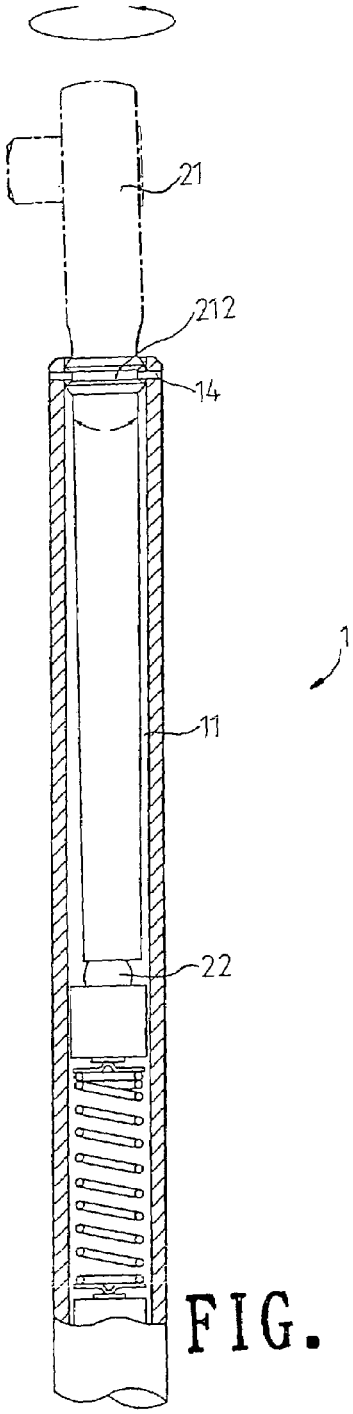
FIG. 5 shows that the head is rotatable and the insertion can be swung an angle in the handle.

As shown in FIGS. 4 and 5, an annular gap is defined between the insertion 211 and an inner periphery of the axial recess 11 of the handle 1 so that the insertion 211 can be swung an angle in the axial recess 11 of the handle 1 and the direction of the engaging member on the head 21 can be rotated to a desired position when needed.

While we have shown and described the embodiment in accordance with the present invention, it should be clear to those skilled in the art that further embodiments may be made without departing from the scope of the present invention.

What is claimed is:

1. A hand tool comprising:

a handle with an axial recess defined in an end thereof and a processing unit connected to the handle;

a head having a driving member connected thereto and an insertion connected to the head, a first notch defined in a distal end of the insertion, and an intermediate member having a second notch defined in a first end thereof and a second end of the intermediate member being a flat surface, a bead engaged with the first and second notches, a spring received in the axial recess of the handle and a first sensor clamped between a first end of the spring and the flat surface, a second sensor clamped between a second end of the spring and an inside of the axial recess, the first and second sensors electrically connected with the processing unit.

2. The hand tool as claimed in claim 1, wherein a first position disk plate is located between the first sensor and the first end of the spring, a second position disk plate is located between the second sensor and the second end of the spring.

3. The hand tool as claimed in claim 1, wherein the insertion is rotatable about an axis of the handle.

4. The hand tool as claimed in claim 3, wherein the insertion includes a groove defined in an outer periphery thereof and two pins radially extend through a wall of the handle and are engaged with the groove.

5. The hand tool as claimed in claim 1, wherein an annular gap is defined between the insertion and an inner periphery of the axial recess of the handle.

* * * * *